US006155616A

United States Patent [19]

Akright

[11] Patent Number: 6,155,616

[45] Date of Patent: Dec. 5, 2000

[54] LOCKING MECHANISM AND CLOSURE ASSEMBLY INCLUDING SAME

[75] Inventor: Michael V. Akright, Columbia, S.C.

[73] Assignee: Randall C. Hansen, Columbia, S.C.

[21] Appl. No.: 08/876,629

[22] Filed: Jun. 16, 1997

[51] Int. Cl.[7] ..... E05C 3/04

[52] U.S. Cl. ..... 292/207; 292/202; 292/198

[58] Field of Search ..... 292/21, 44, 48, 292/53, 99, 100, 92, 102, 198, 203, 207, 213, 216, 227

[56] References Cited

U.S. PATENT DOCUMENTS

| | | | |
|---|---|---|---|
| 1,372,000 | 3/1921 | Anderson | 292/198 |
| 1,389,339 | 8/1921 | Anderson | 292/198 |
| 1,544,960 | 7/1925 | Watts . | |
| 1,711,213 | 4/1929 | Smith | 292/198 |
| 1,902,547 | 3/1933 | Endter | 292/198 |
| 1,902,628 | 3/1933 | Endter | 292/198 |
| 2,146,379 | 2/1939 | Rediger | 292/198 |
| 3,421,785 | 1/1969 | Slattery | 292/216 |
| 3,583,740 | 6/1971 | Armstrong | 292/198 |
| 3,592,496 | 7/1971 | Ploughman | 292/216 |
| 3,667,793 | 6/1972 | Darrin et al. | 292/207 |
| 5,362,116 | 11/1994 | Doyle et al. | 292/DIG. 62 |

FOREIGN PATENT DOCUMENTS

| | | | |
|---|---|---|---|
| 346 922 | 4/1931 | United Kingdom | 292/165 |
| 94/28276 | 12/1994 | WIPO . | |

*Primary Examiner*—Teri Pham
*Attorney, Agent, or Firm*—Dority & Manning, P.A.

[57] ABSTRACT

A locking mechanism and closure assembly are provided including a housing, a latch rotatably mounted to the housing, a spring member for urging the latch from a first position toward a second position, and a control member mounted to the housing for selectively securing the latch against rotation from the first position toward the second position. The control member may be slidably mounted relative to the housing, and may selectively rotate the latch from the first position toward the second position upon failure of the spring member. The latch may be positionable in a third position between the first and second positions, and may have a recess for receiving a striker designed for holding the striker within the recess at some times and guiding the striker into or out of the recess at other times.

30 Claims, 6 Drawing Sheets

40
14
50
52
48
46
44
56
160
158
54
156
80
84
82
20
84
12
32
66
66
86
64
24
22
66
66
28
142
36
30
26
122
38
34

LOCKING MECHANISM AND CLOSURE ASSEMBLY INCLUDING SAME

BACKGROUND OF THE INVENTION

The present invention relates to a locking mechanism and closure assembly, and more particularly relates to a locking mechanism and closure assembly having a latch member rotatably mounted within a housing selectively secured in position by a control member.

Numerous types of closure assemblies are known for securing doors, lids, or covers and allowing them to be reopened. These closure assemblies typically include some sort of a locking mechanism that connects a door with a frame on which the door is mounted, for example, a chassis of a truck or a tool box. These closure assemblies also typically include some sort of a handle mechanism for opening the locking mechanism. Common handle mechanisms include paddle locks, D-rings, and T-bars. The handle mechanism and locking mechanism are somehow connected so that operation of the handle opens the locking mechanism. Typically, the handle and locking mechanisms are mounted on the door opposite a striker bar or some other similar part extending from the frame. Often locking mechanisms are self-closing, so that when the door is closed, the locking mechanism engages the striker to secure the door. Some handle mechanisms include a key-operated lock that disables the handle or locking mechanism to prevent unauthorized or unintended opening of the door.

Various designs of locking mechanisms exist, including so-called rotary locks. Some currently available rotary locks include a latch member rotationally mounted for receiving a striker pin in a recess within the latch. The latch is held in place by a second rotationally-mounted member, which is mounted so as to rotate about a parallel axis to that of the latch and in the same plane as the latch. The latch is spring loaded to move toward an open position, and the second member is spring-loaded to hold the latch from moving toward the open position. The second member is actuated either by direct connection to a handle mechanism, or by an actuating rotating member directly connected to a handle mechanism. These types of lock mechanisms have several drawbacks.

For example, much of the outer casing of conventional locking mechanisms is open, due at least in part to the rotational nature of the second and actuating members. Therefore, the inner workings of the device are liable to become fouled by dirt or moisture which could cause poor operation or rusting, possibly leading to failure. If the spring biasing the latch were to fail, opening the latch could be difficult or impossible, especially if the door is heavy.

Further, the shapes of the recesses of conventional art latches are such that, when in an intermediate position between a fully opened and a fully closed position, they do not securely hold the striker, meaning that the door can then be free to open, which can be dangerous. Also, due to the design of conventional latches and their recesses, the latches do not always securely guide the striker into their recesses, leading to difficulty closing the door or possible damage to the door, locking mechanism, or closure assembly due to jarring while closing.

Also, in conventional locking mechanisms, especially those with direct connection between the second member and the handle mechanism, closing the door partly actuates the handle mechanism, which causes undesired wear and potential damage, especially if the handle mechanism is locked.

OBJECTS AND SUMMARY OF THE INVENTION

It is a principle object of the present invention to provide an improved locking mechanism and closure assembly that can be readily adapted to various applications.

Another object of the present invention is to provide a locking mechanism and closure assembly that is of simple design and manufacture.

Still another object of the present invention is to provide a locking mechanism and closure assembly that avoids being subject to environmental damage.

Yet another object of the present invention is to provide a locking mechanism and closure assembly that can be readily reopened upon failure of the latch biasing member or other members within the mechanism.

Still another object of the present invention is to provide a locking mechanism and closure assembly including an improved latch design.

Yet another object of the present invention is to provide a locking mechanism and closure assembly that securely remains closed when the latch is disposed in an intermediate position between its opened and closed positions.

Still another object of the present invention is to provide a locking mechanism and closure assembly including a latch which more readily receives a striker during closure and retains it afterward.

Yet another object of the present invention is to provide a simplified locking mechanism and closure assembly that prevents activation of or damage to the handle mechanism during closure.

To achieve these objects and, in accordance with the purposes of the invention, as embodied and broadly described herein, a locking mechanism comprises a housing, a latch rotatably mounted to the housing and movable between a first position and a second position, a spring member for urging the latch from the first position toward the second position, and a control member slidably mounted to the housing for selectively securing the latch against rotation from the first position toward the second position.

The latch may preferably include a first groove and a second groove, the control member being positionable to engage the first groove when the latch is in the first position and being positionable to engage the second groove when the latch is in the second position.

The control member may preferably include a rod, a bracket mounted to the rod, and a pin mounted to the bracket for engaging the latch. The rod may be sized to be slidably mounted to the bracket so that, upon sliding movement of the bracket due to rotation of the latch, the rod remains substantially stationary.

The latch, the spring member, the bracket, the central member pin, and the compression spring are all preferably disposed substantially within the housing.

The latch preferably includes a camming surface for engagement by the control member, movement of the control member causing the control member to engage the camming surface to thereby rotate the latch from the first position toward the second position.

The device preferably includes a means for rotating the latch from the first position toward the second position upon failure of the spring member.

Preferably, the latch includes a recess for receiving a striker, the recess being defined by a wall including an inner portion, an outer portion adjacent the inner portion, and a lip adjacent the inner portion and opposite the outer portion. The lip is preferably angled to hold the striker substantially within the inner portion when the latch is in a third position. The outer portion of the recess is preferably angled to guide the striker into the inner portion when the latch is in the first position.

In accordance with another aspect of the invention, a locking mechanism comprises a housing, a latch rotatably mounted to the housing and movable between a first position and a second position, a spring member for urging the latch from the first position toward the second position, and a control member mounted to the housing for selectively securing the latch against rotation from the first position toward the second position and for selectively rotating the latch from the first position toward the second position upon failure of the spring member.

In accordance with another aspect of the invention, a locking mechanism movable relative to a striker for engaging the striker is provided, the locking mechanism comprising a housing, a latch rotatably mounted to the housing movable between a first position, a second position, and a third position between the first and second positions. The latch includes a recess for receiving the striker and a side wall defining an inner portion and a lip adjacent the inner portion. A spring member is mounted to the housing for urging the latch toward the second position from either of the third or first positions. A control member is mounted to the housing for selectively securing the latch against rotation from either of the third or first positions toward the second position. The striker engages the latch along a line of action, and the lip extends in a direction intersecting the line of action to form an obtuse angle substantially opposing the inner portion of the recess when the latch is in the third position.

Preferably, the housing includes an end face defining a slot therethrough from which a portion of the latch extends, the portion including substantially all of the recess when the latch is in the first position, the portion excluding substantially all of the lip when the latch is in the second position.

In accordance with another aspect of the invention, a closure assembly is provided comprising a frame, a door, a striker mounted on one of the frame or the door, a handle mechanism mounted on the other of the frame or the door, and a locking mechanism for engaging the striker mounted on the other of the frame or the door. The locking mechanism includes a latch rotatably mounted to the housing and movable between a first position and a second position, a spring member for urging the latch from the first position toward the second position, and a control member slidably mounted to the housing for selectively securing the latch against rotation from the first position toward the second position. The handle mechanism operatively engages the control member for sliding the control member relative to the housing.

Additional objects and advantages of the invention will be set forth in part in the following written description, or may be obvious from the written description, or may be learned from practice of the invention. Further features, details, and advantages of the invention will become apparent from the claims and the ensuing description of at least one preferred embodiment of the invention, in combination with the drawings.

BRIEF DESCRIPTION OF THE DRAWINGS

The accompanying drawings, which are incorporated in and constitute a part of this specification, illustrate at least one presently preferred embodiment of the invention and, together with the written description, serve to explain the principles of the invention.

DESCRIPTION OF THE PREFERRED EMBODIMENTS

Figure 1:
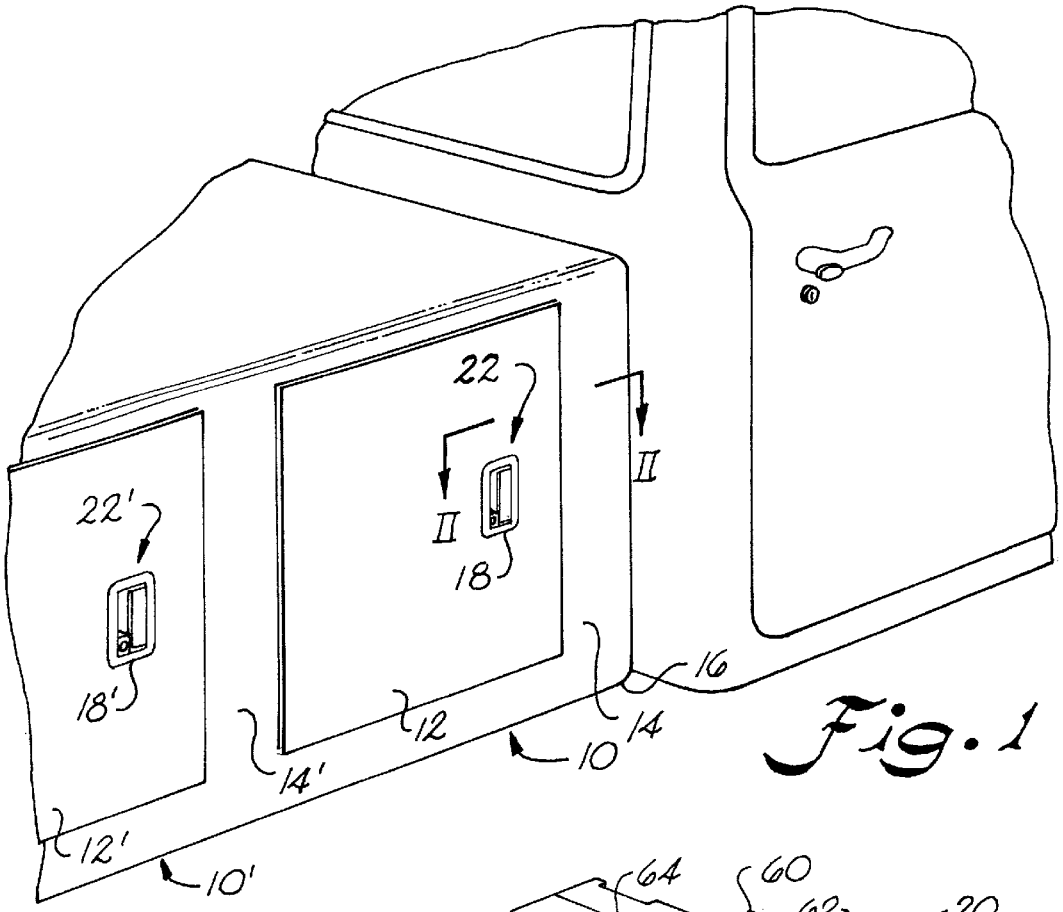
FIG. 1 is a perspective view of a portion of a truck chassis on which a locking mechanism and closure assembly according to the present invention are mounted.

Reference will now be made in detail to the presently preferred embodiments of the invention, one or more examples of which are illustrated in the drawings. Each example is provided by way of explanation of the invention, and not meant as a limitation of the invention. For example, features illustrated or described as part of one embodiment can be used on another embodiment to yield yet another embodiment. It is intended that the present invention include such modifications and variations. It should be apparent to those skilled in the art that various modifications and variations can be made from the examples described herein without departing from the scope and spirit of the invention. The numbering of the components in the drawings is consistent throughout the application, with the same or like components having the same or like numbers in each of the drawings.

As broadly shown and embodied in FIG. 1, a closure assembly 10 includes a door 12 and a frame 14. As specifically shown in FIG. 1, door 12 and frame 14 may form a portion of a truck chassis 16. Alternately, door 12 and frame 14 could form a portion of a toolbox, a door to a building, or any other door, lid, or cover securable to any fixed frame within the scope of the invention. As shown in FIG. 1, two closure assemblies (10 and 10'), doors (12 and 12'), and frames (14 and 14') are provided adjacent each other on chassis 16. Any arrangement of multiple closure assemblies, doors, and frames is also possible within the scope of the invention.

Figure 2:
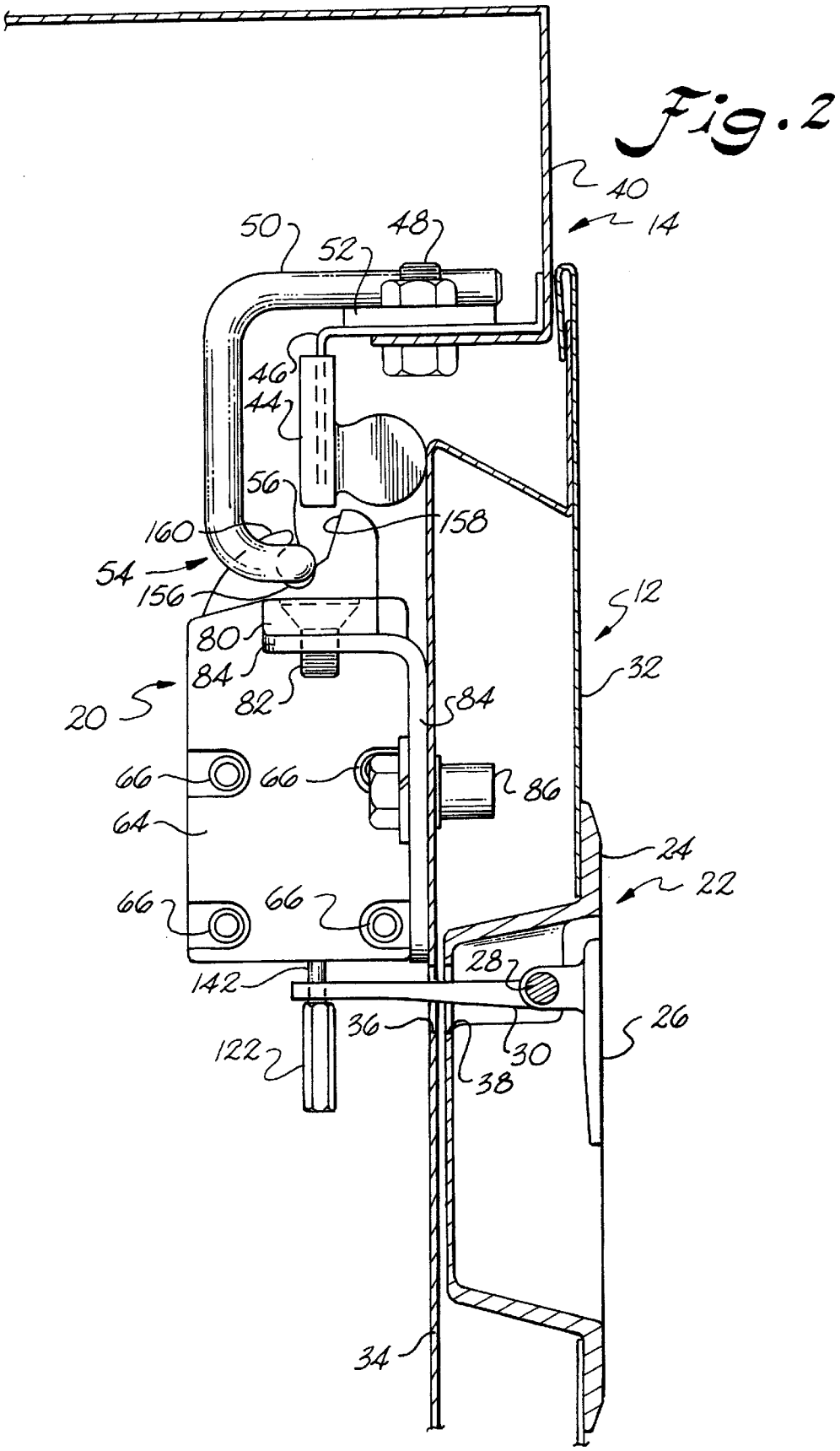
FIG. 2 is a sectional view of a portion of the truck chassis of FIG. 1 taken along line 2—2 in FIG. 1.

Each closure assembly 10 preferably includes a handle mechanism 18 and a locking mechanism 20. The particular handle mechanism 18 used with closure assembly 10 may be any commonly used handle mechanism. As shown in FIGS. 1 and 2, handle mechanism 18 may comprise a paddle lock 22 including a tray 24 and a paddle handle 26 rotatably mounted about an axle 28 secured to tray 24. An arm 30 is mounted for rotation with axle 28. Thus, when a user pulls outwardly on the handle to rotate it counterclockwise, as shown in FIG. 2, arm 30 is also rotated counterclockwise. Tray 24 is mounted to a front surface 32 of door 12 by bolts, screws, or any other conventional securing device (not shown). Door 12 may include a rear surface 34 as shown in FIG. 2, and slots may be provided at corresponding positions through door rear surface 34 (slot 36) and through tray 24 (slot 38) for receiving arm 30.

In the orientation shown in FIG. 2, the hinge (not shown) for door 12 is at the bottom. Frame 14 includes wall 40 having an opening flange 42 on which a stopper member 44 is mounted via a mounting plate 46. Stopper 44 is preferably a flexible member for cushioning jarring when door 12 is closed and maintaining some tension on closure assembly 10 to prevent rattling of door 12 on frame 14 after door 12 is closed. Mounting plate 46 is secured to opening flange 42 via bolts 48 which also secure striker bar 50 to opening flange 42 via a striker flange 52.

Striker bar 50 includes a distal end 54 for engaging locking mechanism 20. As shown in FIG. 2, end 54 includes an engagement portion 56 extending substantially parallel to axle 28 for engaging locking mechanism 20, as will be described below. Preferably, striker bar 50 is U-shaped, and has two arms 58 (one visible in FIG. 2) that are attached to opening flange 42 with engagement portion 56 in between. However, the particular design of the striker may be varied to any shape suitable for engaging locking mechanism 20 within the scope of the invention.

It should also be understood that the specific paddle lock 22 described herein is only a single example of a suitable handle mechanism 18 for use with closure assembly 10 of the present invention. Also, closure assembly 10 may be used with various door and frame designs within the scope of the invention.

Figure 3:
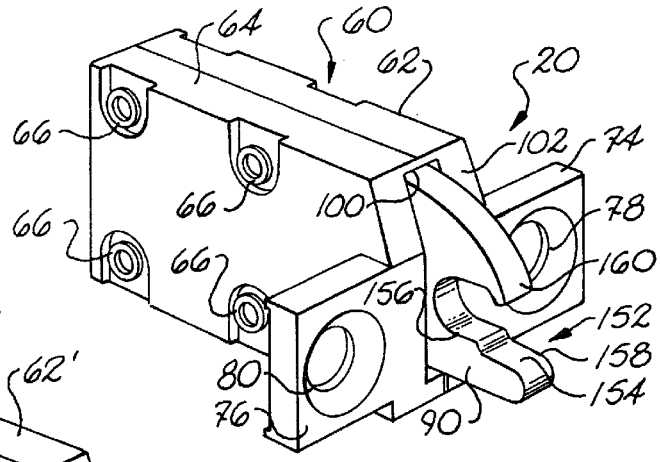
FIG. 3 is a perspective view of the locking mechanism of the device of FIG. 2.
Figure 5:
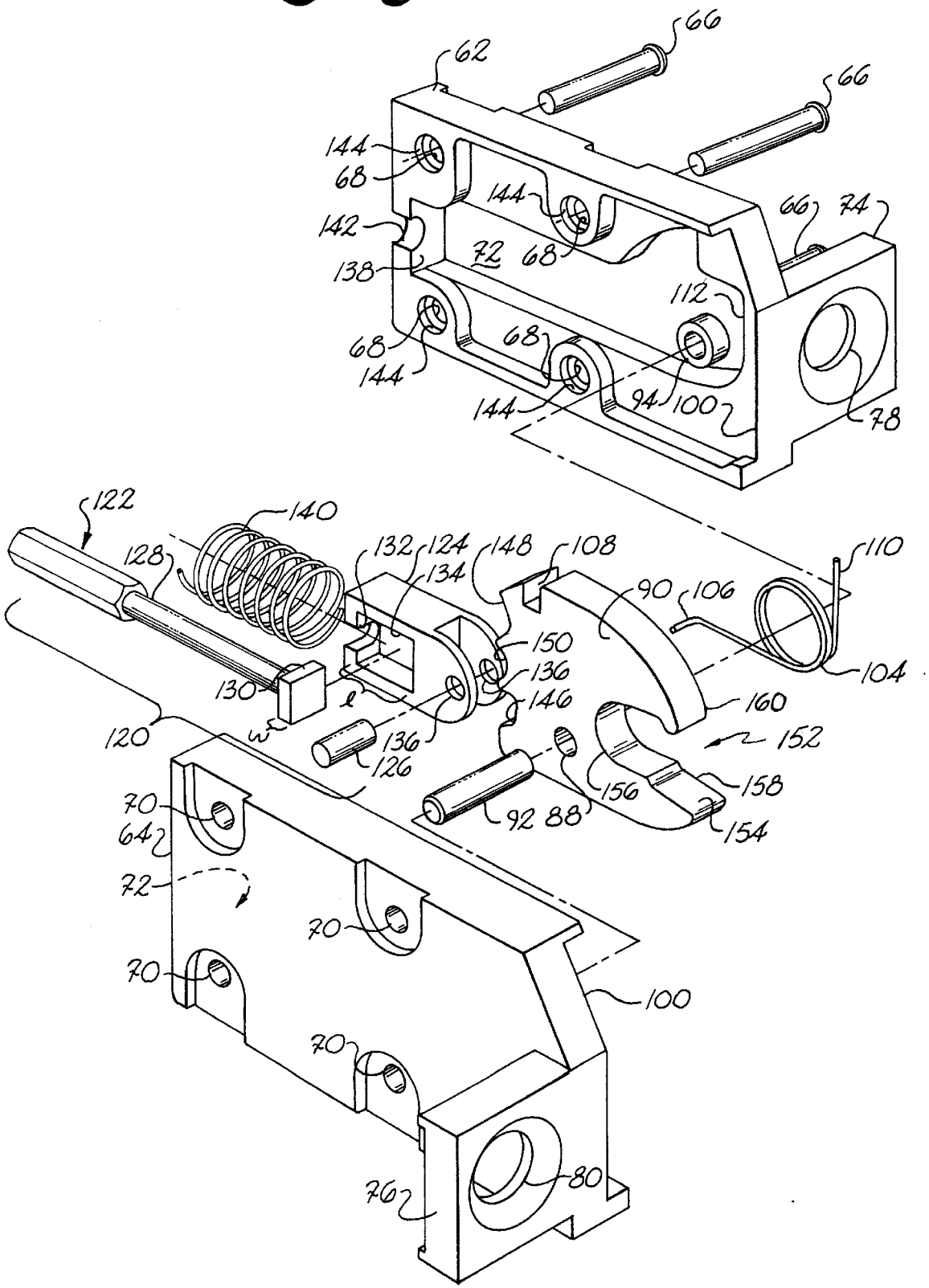
FIG. 5 is an exploded perspective view of the locking mechanism of FIG. 3.

An exemplary embodiment of a locking mechanism 20 according to the present invention in shown in FIGS. 2, 3, and 5. Locking mechanism 20 includes a housing 60 having halves 62 and 64. As shown in the figures, halves 62 and 64 are joined by four rivets 66, although any other suitable joining devices such as bolts, screws, welds, etc. could be used within the scope of the invention. Rivets 66 are disposed in holes 68 and 70 correspondingly machined into halves 62 and 64. Between them, halves 62 and 64 define a cavity 72 within housing 60 (See FIG. 5).

Halves 62 and 64 preferably include extending mounting flanges 74 and 76 including mounting holes 78, 80 for mounting halves 62, 64 to a door 12 or frame 14. As shown in FIG. 2, locking mechanism 20 can be secured to door 12 by screws 82 connecting mounting flange 80 to a mounting plate 84 secured by further screws 86 to rear surface 34 of door 12. However, locking mechanism 20 could be secured to door 12 in various other ways.

Figure 4:
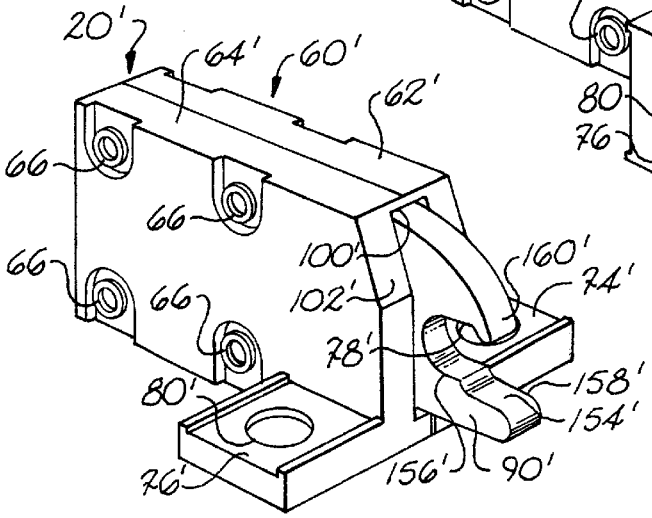
FIG. 4 is a perspective view of an alternate embodiment of the locking mechanism of FIG. 3 with differently-located mounting flanges.

For example, an alternate embodiment of locking mechanism 20 is shown in FIG. 4. In FIG. 4, alternate locking mechanism 20' is essentially similar to locking mechanism 20 of FIG. 3, except that locking mechanism 20' includes differently-located mounting flanges 74' and 761. The location of mounting flanges 74' and 76' allows locking mechanism 20' to be bolted directly to door rear surface 34 if desired without the need for any intermediate mounting plate, such as plate 84, and without any additional screws 86. It should be understood that mounting flanges 74 and 76, and 74' and 76' could be located anywhere along the surfaces in which they are shown in FIGS. 3 and 4. Further, it should be understood that the mounting flanges could be disposed on the ends of the housings opposite those in which they are shown in FIGS. 3 and 4, assuming suitable attachment hardware such as modified mounting plates was used.

As shown best in FIG. 5, a latch 90 is rotatably mounted on a pin 92 secured in a hole 88 in the latch and extending between halves 62 and 64. Pin 92 is secured within halves 62 and 64 by cups 94 (see half 62 in FIG. 5). Latch 90 thus rotates about central axis 96 of pin 92 within housing 60. As shown in FIG. 3, a portion 98 of latch 90 extends out of housing 60 through a slot 100 in an end face 102 of housing 60. As will be discussed below, the size of portion 98 extending from end face 102 varies depending upon the rotational position of latch 90 relative to housing 60.

A spring member 104 is provided for urging latch 90 from a first position toward a second position. As shown in FIG. 5, spring member 104 is a coil spring mounted within cavity 72 of housing 60. Spring member 104 is mounted about cup 94. One end 106 of spring member 104 engages slot 108 in latch 90. The other end 110 of spring member 104 engages a bearing surface 112 within housing half 62. Spring member 104 is mounted in compression between slot 108 and bearing surface 112. Thus, as shown in FIGS. 2 and 5, spring member 104 urges latch 90 in a counterclockwise direction.

A control member 120 is slidably mounted to housing 60 and selectively secures latch 90 against rotation from a first position toward a second position, as will be described below. As shown in FIG. 5, control member 120 includes a rod 122, a bracket 124 mounted to the rod, and a pin 126 mounted to bracket 124 for engaging latch 90. Rod 122 includes an extending portion 128 and a flange portion 130. Bracket 124 includes a recess 132 for receiving extending portion 128 of rod 122 and a slot 134 for receiving flange portion 130 of rod 122. Rod 122 is slidable within bracket 124 along the length of slot 134. As shown in FIG. 5, slot 134 is sized so that it has a length L less than the width W of flange portion 130 of rod 122.

A compression spring member 140 is disposed about extending portion 128, and is mounted between housing 60 and bracket 124. Compression spring 140 is compressed between bracket 124 and a bearing surface 138 of housing 60 (see housing half 62 in FIG. 5). A hole 142 extending through housing 60 receives extending portion 128 of rod 122.

Thus, in order to assemble control member 120, pin 126 is slid into bracket 124. Rod 122 is slid into bracket 124 so that extending portion 128 fits within recess 132. Compression spring 140 is slid over rod 122 from the end opposite rod flange portion 130. The assembled control member 120 and compression spring 140 are then placed within one of the locking mechanism housing halves 62 or 64 while compressing compression spring 140 so that extending portion 128 of rod 122 fits within hole 142 and compression spring 140 is compressed between bracket 124 and bearing surface 138. The other half 64 or 62 can then be put in place to hold the assembled control member 120 and compression spring 140 within housing 60. Hole 142 should be sized only slightly larger than extending portion 128 of rod so that the extending portion cannot slip out of recess 132 in bracket 124 after assembly. Once halves 62 and 64 are placed together, they are attached together by rivets 66. Rivet holes 68 and 70 may include guides (see counter bores 144 in half 62 for mating with annular ridges (not shown) in half 64) to assist in aligning halves 62 and 64. Alternately, the guides could be other shapes and could be located in other places on the housing if desired.

In order to assemble the latch 90 and associated parts, spring member 104 is placed within housing half 62 with end 110 adjacent bearing surface 112. Pin 92 is then placed through hole 88 in latch 90 and slid into cup 94. Engaging portion 106 of spring 104 is then slid into slot 108. As will be described below, once control member 120 and latch 90 are assembled, pin 126 of control member 120 will be engaging latch 90 at some location. Either control member 120 or latch 90 may be assembled first.

Arm 30 and control member 120 may be operatively engaged in various ways within the scope of the invention. For example, as shown in FIG. 2, arm 30 may simply rest against a widened portion 123 of control member 120. A slot (not shown) could be provided in arm 30 for retaining widened portion, or a rotatable joining member (not shown) could be mounted to arm 30 and control member 120. An extending piece (not shown) could also be threaded into or onto the end of widened portion 123 if desired, and handle mechanism 18 could thus be located distant from locking mechanism 20.

Figure 6:
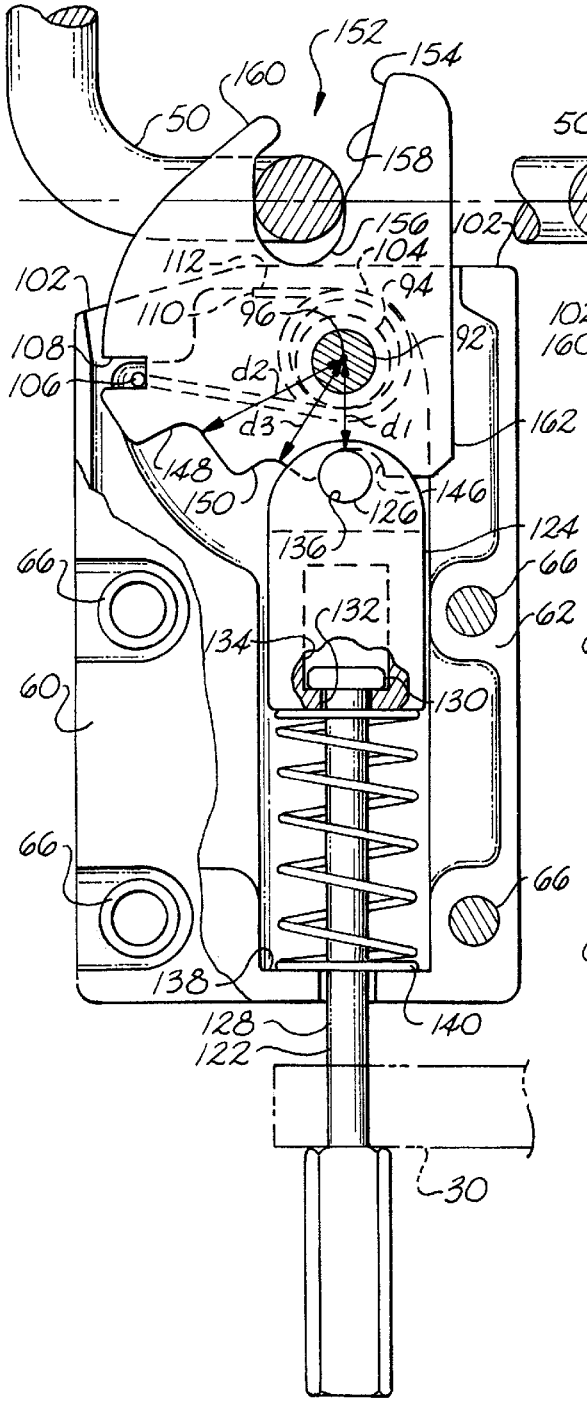
FIG. 6 is a partially broken-out sectional view of the locking mechanism of FIG. 3 engaging a striker in a closed position.
Figure 7:
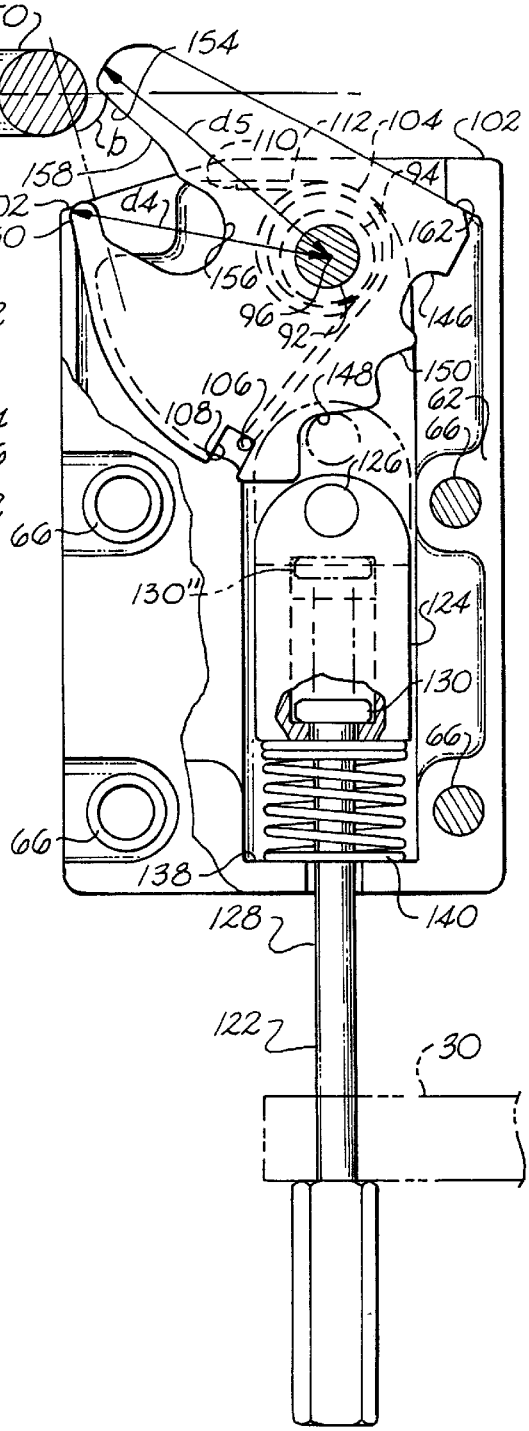
FIG. 7 is a partially broken-out sectional view of the locking mechanism of FIG. 6 in an opened position.
Figure 8:
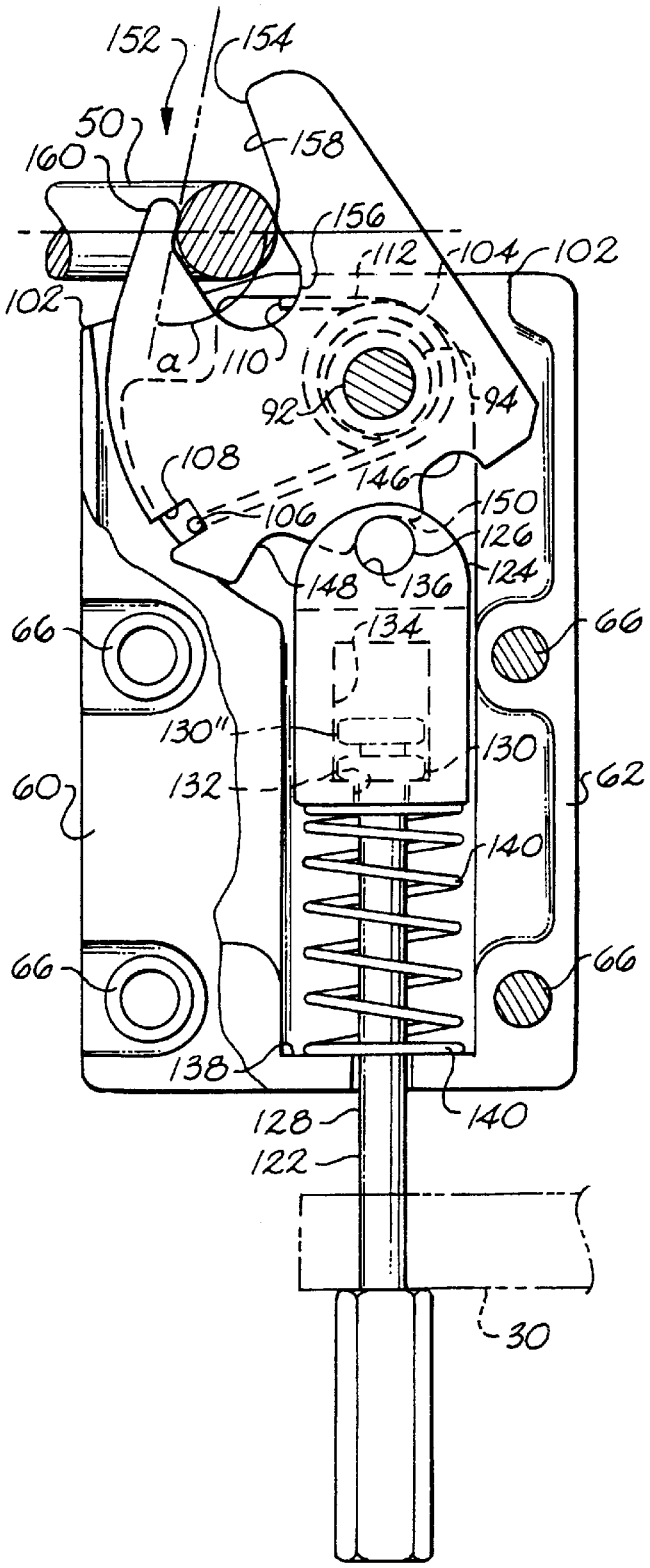
FIG. 8 is a partially broken-out sectional view of the locking mechanism of FIG. 6 in an intermediate position between the positions of FIGS. 6 and 7.

Control member 120 is slidably mounted to housing 60 for selectively securing latch 90 against rotation from a first position toward a second position. Latch member 90 preferably includes at least one groove for receiving control member 120. As shown in FIG. 5, latch 90 includes a first groove 146, a second groove 148, and a third groove 150 in between the first and second grooves. FIGS. 6, 7, and 8, respectively, show pin 126 of control member 120 engaging first groove 146, second groove 148, and third groove 150 when latch 90 is respectively in a first position, second position, and third position. As shown in FIG. 6, first groove 146 is located a first distance $d_1$, second groove 148 is located a second distance $d_2$, and third groove 150 is located a third distance $d_3$ from pin central axis 96. $d_2$ is greater than $d_3$ which is greater than $d_1$.

As shown in FIGS. 3 and 5, latch 90 includes a recess 152 for receiving striker 50. Recess 152 is defined by a wall 154 including an inner portion 156, an outer portion 158 adjacent the inner portion, and a lip 160 adjacent the inner portion and opposite the outer portion. Lip 160 extends so as to narrow recess 152 relative to inner portion 156. Outer portion 158 extends so as to widen recess 152 relative to inner portion 156. As will be described below, lip 160 is angled in order to hold striker 150 substantially within inner portion 156 when latch 90 is in the third position. Further, outer portion 158 is angled to guide striker 50 into inner portion 156 when latch 90 is in the second position. Outer portion 158 is machined into latch 90 so that striker 50 has a clear path into inner portion 156 of recess 152 past extending lip 160. If outer portion 158 were not machined into latch 90, lip 160 would prevent striker 50 from fitting into inner portion 156 of recess 152.

The design of lip 160 is such that it extends in a direction intersecting a line of action 1 of striker 50 (see FIG. 8) to form an obtuse angle a substantially opposing inner portion 156 of recess 152 when latch 90 is in the third position. Lip 160 is also designed so that it extends in a direction intersecting the line of action of striker 50 to form an acute angle b substantially opposing inner portion 156 of recess 152 when latch 90 is in the second position (see FIG. 7). The design of the angle of lip 160 along with the positioning of third groove 150 and second groove 148 allow lip 160 to retain striker 50 within recess 152 when latch 90 is in the third position, and allow striker 52 move in to or out of recess 152 when latch 90 is in the second position.

The operation of latch 90 during opening and closing of locking mechanism 20 is as follows. FIGS. 2 and 6 show the closure assembly and locking mechanism 20 in the closed first position, with the handle not being manipulated by a user. In this position, the closure assembly 10 is locked. Control member 120 (via pin 126) is engaging first groove 146 of latch 90. Compression spring 140 is urging pin 126 (via bracket 124) into engagement with first groove 146. Spring member 104 is mounted in compression between slot 108 in latch 90 and bearing surface 112 in half 62. However, the engagement of pin 126 in first groove 146 prevents latch 90 from rotating. Thus, if someone were to attempt to open door 12 by pulling it to the right (see FIG. 2), latch 90 will be secured against rotation and would hold striker 50 within inner portion 156 of recess 152, thereby maintaining the door closed.

If one were to utilize handle mechanism 18 and pull handle 26 slightly, arm 30 would cause control member 120 to move downward slightly (see FIG. 6), thereby compressing compression spring 140 and causing pin 126 to move further from central axis 96 of latch pin 92. Eventually, latch 90 would rotate to the third position as pin 126 was pulled out of first groove 146, and pin 126 would engage third groove 150, as shown in FIG. 8. In this position, striker 50 is held by lip 160, thereby preventing opening of door 12. Thus, in this position, locking mechanism 20 is still considered locked.

If one were to continue pulling handle 26, control member 120 would continue to slide out of housing 60 until bracket 124 and pin 126 reach the position shown in dotted lines in FIG. 7. In this position, pin 126 resides in second groove 148, and latch 90 is in the second position. In this position, striker 50 is no longer retained by recess 152. Lip 160 is angled so that, when latch 90 is in the second position, it no longer retains striker 50 within recess 152 (compare angles b and a in FIGS. 7 and 8). Latch 90 may include a stop 162 engaging a portion of housing 60 to prevent any further rotation of latch 90 once it reaches the second position.

If handle 26 were pulled further so that bracket 124 would fully compress compression spring 140, as shown in solid lines in FIG. 7, stop 162 prevents latch 90 from rotating any further under the influence of spring member 104, even though pin 126 no longer engages latch 90.

In order to close closure assembly 10 from the open position (shown in FIG. 7), one would slam door 12 so that latch 90 is pushed into engagement with striker 50. Striker 50 would first engage outer portion 158 of recess 152, angled so as to receive striker 50 and guide it into inner portion 156 of recess 152 past lip 160. Closing door 12 causes striker to rotate latch 90 from the second position to the third position and ultimately to the first position, thereby compressing spring member 104 and allowing compression spring 140 to expand as pin 126 moves from second groove 148 to third groove 150 and first groove 146.

If door 12 were not closed all the way, latch 90 would rotate perhaps only to the third position, intermediate between the first and second position. In this position, lip 160 would securely hold striker 50 within recess 152. Such an intermediate position is desirable for safety reasons, for example, when someone inadvertently does not apply enough effort to move a latch all the way from the second position to the first position, locking mechanism 20 will still remain in a relatively secure locked position. Closing door 12 further to push striker 50 into inner portion 156 of recess 152 provides an even more secure closure. In that position, pin 126 engages first groove 146.

Control member 120 thus, under the influence of spring member 104 and compression spring 140 selectively secures latch 90 against rotation from either of the third or first positions toward the second position.

During closure of the door, as striker 50 is moved into recess 152, rotating latch 90 as it goes, rod 122 of control member 120 remains substantially stationary. Pin 126 and bracket 124 follow the surface of latch 90 moving from first groove 146 to third groove 150 and second groove 148. Bracket 124 thus moves back and forth against compression spring 140. The sequence of FIGS. 6, 8, and 7 show control member 120 being pulled due to movement of paddle handle 26 to thereby open locking mechanism 20. However, during closure of locking mechanism 20, arm 30 and rod 122 would remain in the position shown in FIG. 6 at all times. Therefore, bracket 124 would move from the dotted line position shown in FIG. 7, to the position shown in FIG. 8, to the position shown in FIG. 6 without substantial movement of arm 30 or rod 122. The upper location of rod flange 130 (130') shown in FIG. 8 indicates the position of rod 122 during closure of locking mechanism 120 due to rotation of latch 90 by striker 50. As seen, bracket 124 has slid down over rod flange portion 130'. Similarly, in FIG. 7, rod flange portion 130" shows the position of the rod flange during closure of locking mechanism 20, assuming handle 26 and arm 30 have not been moved by user. In order to prevent undesired movement of handle 26 during closure of locking mechanism 20, slot 134 in bracket 124 should be long enough to allow rod flange portion 130 to slide within slot 124 a distance equal to the difference between $d_2$ and $d_1$ (difference in respective distances from second groove 148 and first groove 146 and pin central axis 96).

The design of latch 90 is such that portion 98 of latch 90 extending from slot 100 in end face 102 of housing 60 varies during rotation of latch 90. Portion 98 includes substantially all of recess 152 when latch 90 is in the first position, and portion 98 excludes substantially all of lip 160 when latch 90 is in the second position (compare FIGS. 6 and 7). Thus, latch 90 extends from housing 60 to engage and hold striker 50 when closure assembly 10 is locked. However, when closure assembly 10 is fully opened, lip 160 is out of the way of striker 50 permitting smooth closure. Outer portion 158 extends a first distance $d_4$ from pin central axis 96, and lip 160 extends a second distance $d_5$ from pin central axis 96, the first distance being greater than the second (see FIG. 7). Thus, during closure, lip 160 or inner portion 156 are unlikely to engage striker 50, which should thus engage outer portion 158. Further, lip 160 is substantially held within slot 100, thereby protecting the entire locking mechanism 20 and closure assembly 10 from damage due to improper contact during closing.

Figure 9:
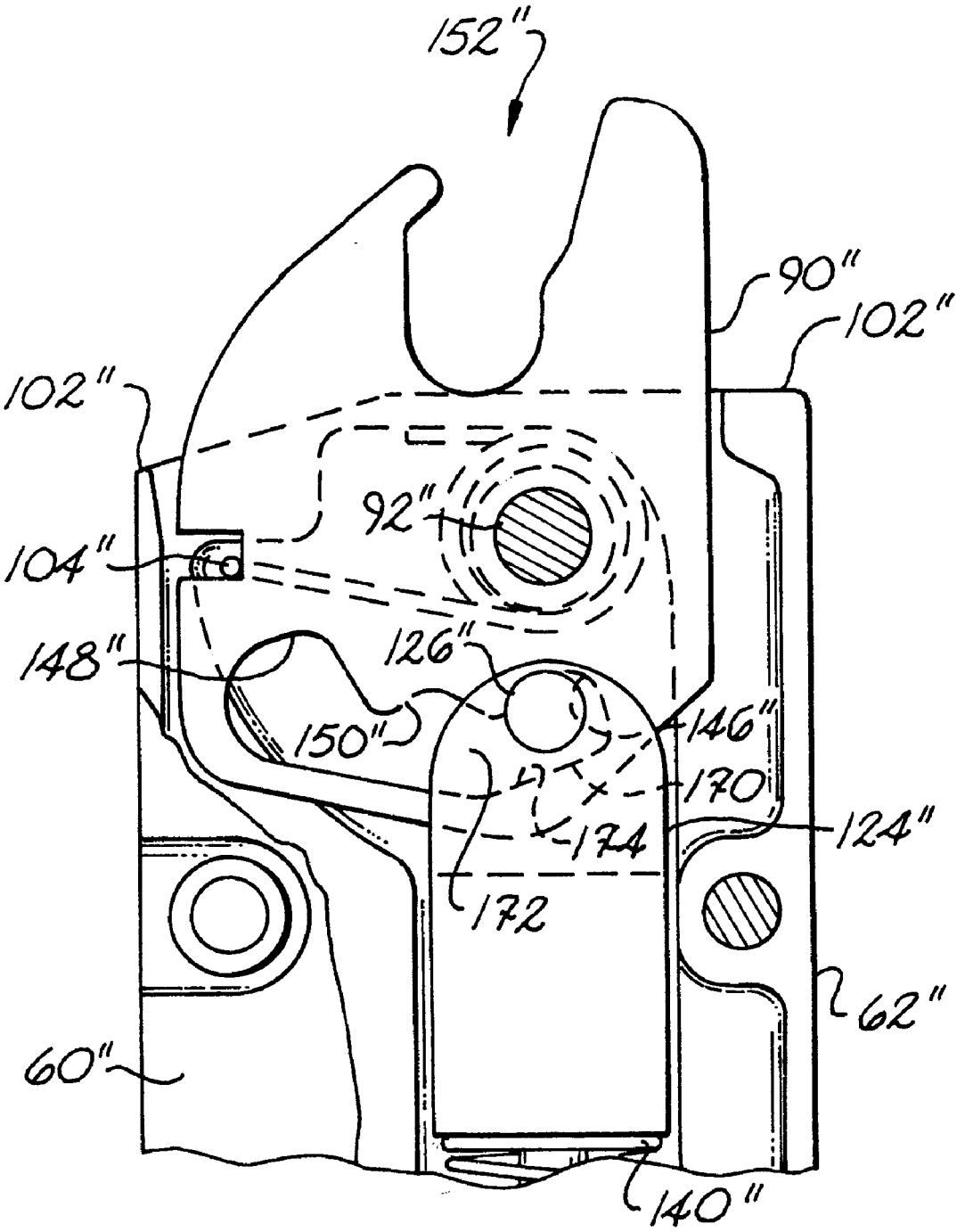
FIG. 9 is a partially broken-out sectional view of an alternate embodiment of the locking mechanism according to the present invention, including a latch having a camming surface for reopening the locking mechanism.

An alternate embodiment of locking mechanism 20 is shown in FIG. 9. In FIG. 9, locking mechanism 20" includes a means for rotating latch 90" from the first position toward the second position upon failure of spring member 104". As broadly embodied in FIG. 9, the means for rotating the latch includes a camming surface 170 for engagement by control member pin 126". If spring member 104" were to break or otherwise fail to provide suitable force for rotating latch 90" from the first position, movement of control member 120" via a handle (not shown in FIG. 9) causes pin 126" of control member 120" to engage camming surface 170 to thereby rotate latch 90" from the first position toward the second position. Preferably, traveling from right to left (see FIG. 9), camming surface 170 is disposed a further distance from pin center axis 96, so that continued pulling on control member 120" causes continued camming of latch 90" until the latch is in the second position.

Preferably, latch 90" defines an opening 172 therethrough, and camming surface 170 is disposed on a portion of the opening. When the handle is pulled, the control member pin 126" selectively rotates latch 90", thereby assisting in the opening of locking mechanism 20". The door (not shown in FIG. 9) can then be further opened by pulling the handle at the same time to keep pin 126" from engaging third groove 150" on the way to reaching second groove 148".

As shown in FIG. 9, camming surface 170 is disposed on a side wall 174 of opening 172 extending through latch 90". Opening 172 may have various shapes and need not be fully enclosed by side wall 174, as long as camming surface 170 is shaped to perform the function of helping rotate latch 90". As shown in FIG. 9, pin 126" extends through opening 172, and both ends of pin 126" are secured within bracket 124".

The operation of the alternate embodiment of FIG. 9 is essentially similar to that of the previous embodiments, except for the addition of the camming surface 170. Camming surface 170 is operational even if spring member 104" is not broken or disabled to assist opening of latch 90", assuming the handle is pulled firmly enough to unseat pin 126" from first groove 146".

Locking mechanism 20 is preferably made substantially from metallic parts. For example, housing halves 62 and 64 are preferably die cast from zinc, such as Zamak #3 or SAE-903. Latch 90 is preferably made of a sintered metal such as FX-2010-T. Control member rod 122 and pins 126 and 92 are preferably made of a mild steel. Control member bracket 124 is preferably made from a plastic such as nylon 6/6, which is preferable to metal for this part to reduce the weight of the control member, to reduce friction, and to avoid galvanic action.

It will be apparent to those skilled in the art that various modifications and variations can be made in the present invention without departing from the scope and spirit of the invention. It is intended that the present invention include such modifications and variations that come within the scope of the appended claims and their equivalence.

I claim:

1. A locking mechanism comprising:

a housing;

a pin;

a latch rotatably mounted to the housing via the pin so as to rotate around a central axis of the pin and movable between a first position and a second position, the latch including a first groove disposed a first distance from the pin central axis and a second groove disposed a second distance from the pin central axis the second distance being greater than the first distance;

a spring member for urging the latch from the first position toward the second position; and a control member having a first part extending from and slidably mounted to the housing, and a second part slidably mounted to the first part, the second part being urged in a first direction for engaging the latch and securing the latch against rotation from the first position toward the second position and being movable via the first part in a second direction opposite the first direction for allowing such rotation, the control member being positionable to engage the first groove when the latch is in the first position and being positionable to engage the second groove when the latch is in the second position.

2. The locking mechanism of claim 1, wherein the latch includes a third groove disposed between the first and second grooves, the control member being positionable to engage the third groove when the latch is in a third position between the first and second positions.

3. The locking mechanism of claim 2, wherein the latch includes a recess for receiving a striker, the recess being defined by a wall including an inner portion, an outer portion adjacent the inner portion, and a lip adjacent the inner portion and opposite the outer portion.

4. The locking mechanism of claim 1, wherein the control member is secured to a handle mechanism, actuation of the handle mechanism sliding the control member relative to the housing.

5. The locking mechanism of claim 1, further including a compression spring mounted between the housing and the control member for urging the control member into engagement with the latch.

6. The locking mechanism of claim 1, wherein the latch includes a recess for receiving a striker, the recess being defined by a wall including an inner portion, an outer portion adjacent the inner portion, and a lip adjacent the inner portion and opposite the outer portion, the outer portion extending a first distance from the pin central axis and the lip extending a second distance from the pin central axis, the first distance being greater than the second distance.

7. The locking mechanism of claim 1, further including a compression spring for urging the second part in the first direction.

8. The locking mechanism of claim 7, wherein the compression spring is mounted between the housing and the second part.

9. A locking mechanism comprising:

a housing;

a latch rotatable mounted to the housing and movable between a first position and a second position;

a spring member for urging the latch from the first position toward the second position; and a control member having a first part extending from and slidably mounted to the housing and a second part slidably mounted to the first part, the second part being urged in a first direction for engaging the latch and securing the latch against rotation from the first position toward the second position and being movable via the first part in a second direction opposite the first direction for allowing such rotation, wherein the control member first part includes a rod and the control member second part includes a first pin, the control member further including a bracket mounted to the rod, the first pin being mounted to the bracket.

10. The locking mechanism of claim 9, wherein the rod is sized to be slidably mounted to the bracket so that, upon sliding movement of the bracket due to rotation of the latch, the rod remains substantially stationary.

11. The locking mechanism of claim 9, wherein the latch includes a first groove and a second groove, the control member being positionable to engage the first groove when the latch is in the first position and being positionable to engage the second groove when the latch is in the second position; and further including a second pin mounted to the housing, the latch being rotatable mounted to the housing via the second pin so as to rotate around a central axis of the second pin wherein the first groove is disposed a first distance from the second pin central axis and the second groove is disposed a second distance from the second pin central axis, the second distance being greater than the first distance, wherein the latch and bracket are sized so that the rod is slidable within the bracket a distance at least as large as the difference between the second distance and the first distance.

12. The locking mechanism of claim 9, wherein the rod includes an extending portion and a flange portion, and the bracket includes a recess for receiving the extending portion and a slot for receiving the flange portion.

13. The locking mechanism of claim 9, further including a compression spring member mounted between the housing and the bracket for urging the control member pin into engagement with the latch.

14. The locking mechanism of claim 13, wherein the slot has a length and the end flange has a width less than the length of the slot, the end flange being slidable within the slot during movement of the bracket in a direction to compress the compression spring due to rotation of the latch.

15. The locking mechanism of claim 10, wherein the latch is rotatable from the first position to the second position via the spring member when the rod is slid in a direction to compress the compression spring, the control member first pin moving from the first groove to the second groove during rotation of the latch from the first position to the second position.

16. The locking mechanism of claim 10, wherein the latch, the spring member, the bracket, the control member first pin, and the compression spring are all disposed substantially within the housing.

17. Locking mechanism comprising:

a housing;

a latch rotatably mounted to the housing and movable between a first position and a second position, the latch defining an opening therethrough;

a spring member for urging the latch from the first position toward the second position; and a control member slidably mounted to the housing for selectively securing the latch against rotation from the first position toward the second position, the latch including a camming surface disposed on a portion of the opening for engagement by the control member, movement of the control member causing the control member to engage the camming surface to thereby rotate the latch from the first position toward the second position.

18. A locking mechanism comprising:

a housing;

a latch rotatably mounted to the housing and movable between a first position and a second position;

a spring member for urging the latch from the first position toward the second position;

a control member slidably mounted to the housing for selectively securing the latch against rotation from the first position toward the second position; and means disposed on the latch and the control member for rotating the latch from the first position toward the second position upon failure of the spring member.

19. A locking mechanism comprising:

a housing;

a latch rotatably mounted to the housing and movable between a first position and a second position;

a spring member for urging the latch from the first position toward the second position; and a control member slidably mounted to the housing for selectively securing the latch against rotation from the first position toward the second position, latch including a first groove and a second groove, the control member being positionable to engage the first groove when the latch is in the first position and being positionable to engage the second groove when the latch is in the second position, the latch further including a third groove disposed between the first and second grooves, the control member being positionable to engage the third groove when the latch is in a third position between the first and second positions, the latch further including a recess for receiving a striker, the recess being defined by a wall including an inner portion, an outer portion adjacent the inner portion, and a lip adjacent the inner portion and opposite the outer portion, the lip being angled to hold the striker substantially within the inner portion when the latch is in the third position.

20. The locking mechanism of claim 19, wherein the lip extends so as to narrow the recess relative to the inner portion.

21. A locking mechanism comprising:

a housing:

a latch rotatably mounted to the housing and movable between a first position and a second position;

a spring member for urging the latch from the first position toward the second position; and a control member slidably mounted to the housing for selectively securing the latch against rotation from the first position toward the second position, the latch including a first groove and a second groove, the control member being positionable to engage the first groove when the latch is in the first position and being positionable to engage the second groove when the latch is in the second position, the latch further including a third groove disposed between the first and second grooves, the control member being positionable to engage the third groove when the latch is in a third position between the first and second positions, the latch further including a recess for receiving a striker, the recess being defined by a wall including an inner portion, an outer portion adjacent the inner portion, and a lip adjacent the inner portion and opposite the outer portion, the outer portion of the recess being angled to guide the striker into the inner portion when the latch is in the first position.

22. The locking mechanism of claim 21, wherein the outer portion of the recess extends so as to widen the recess relative to the inner portion.

23. A locking mechanism comprising:

a housing;

a latch rotatably mounted to the housing and movable between a first position and a second position, the latch including a camming surface;

a spring member for urging the latch from the first position toward the second position; and a control member mounted to the housing for selectively securing the latch against rotation from the first position toward the second position and for selectively rotating the latch from the first position toward the second position upon failure of the spring member by engaging the camming surface.

24. The locking mechanism of claim 23, wherein the camming surface is disposed on a side wall of an opening extending through the latch, and wherein the control member includes a pin extending into the opening for contacting the camming surface.

25. The locking mechanism of claim 24, wherein the control member includes a bracket extending around a part of the latch, the pin having two ends each being received within the bracket.

26. A locking mechanism movable relative to a striker for engaging the striker, the locking mechanism comprising:

a housing;

a latch rotatably mounted to the housing movable between a first position, a second position, and a third position between the first and second positions, the latch including a recess for receiving the striker and including a side wall defining an inner portion and a lip adjacent the inner portion;

a spring member mounted to the housing for urging the latch toward the second position from either of the third or first positions; and a control member mounted to the housing for selectively securing the latch against rotation from either of the third or first positions toward the second position, the striker engaging the latch along a line of action, the lip extending in a direction intersecting the line of action to form an obtuse angle substantially opposing the inner portion of the recess when the latch is in the third position.

27. The locking mechanism of claim 26, wherein the housing includes an end face defining a slot therethrough from which a portion of the latch extends, the portion including substantially all of the recess when the latch is in the first position, the portion excluding substantially all of the lip when the latch is in the second position.

28. The locking mechanism of claim 26, wherein the lip extends in a direction intersecting the line of action to form an acute angle substantially opposing the inner portion of the recess when the latch is in the second position.

29. A closure assembly comprising:

a frame;

a door;

a striker mounted on one of the frame or the door;

a handle mechanism including a paddle handle mounted on the other of the frame or the door; and a locking mechanism for engaging the striker mounted on the other of the frame or the door, the locking mechanism including a latch rotatably mounted to the housing and movable between a first position and a second position, a spring member for urging the latch from the first position toward the second position, and a control member slidably mounted to the housing for selectively securing the latch against rotation from the first position toward the second position, the handle mechanism operatively engaging the control member for sliding the control member relative to the housing.

30. The closure assembly of claim 29, wherein the locking mechanism and the handle mechanism are mounted to the door.

* * * * *